US006491770B1

(12) United States Patent
Knott, Sr.

(10) Patent No.: US 6,491,770 B1
(45) Date of Patent: Dec. 10, 2002

(54) STRAND GALVANIZING LINE

(76) Inventor: James M. Knott, Sr., 456 Hill St., Whitinsville, MA (US) 01388

( * ) Notice: Subject to any disclaimer, the term of this patent is extended or adjusted under 35 U.S.C. 154(b) by 0 days.

(21) Appl. No.: 09/584,213

(22) Filed: May 31, 2000

(51) Int. Cl.[7] ..... B05D 1/18
(52) U.S. Cl. ..... 148/526; 148/533; 148/596
(58) Field of Search ..... 148/526, 533, 148/595, 596

(56) References Cited

U.S. PATENT DOCUMENTS 4,242,154 A * 12/1980 Pilling ..... 148/533
4,390,377 A 6/1983 Hogg
5,128,172 A * 7/1992 Whittick ..... 148/526
5,399,376 A 3/1995 Flinchum et al.
5,705,228 A * 1/1998 Kornmann ..... 427/430.1

* cited by examiner

*Primary Examiner*—George Wyszomierski
(74) *Attorney, Agent, or Firm*—Samuels, Gauthier & Stevens, LLP

(57) ABSTRACT

A method for annealing and galvanizing wires which comprises induction heating the wires in a first chamber at a first higher temperature to anneal the wires, cooling the wires to a second lower temperature in a second chamber and galvanizing the wires in a third chamber. The chambers are in serial communication and the heating, cooling and galvanizing steps are effected in an oxygen free atmosphere.

6 Claims, 2 Drawing Sheets

STRAND GALVANIZING LINE

FIELD OF THE INVENTION

Strand wire annealing and zinc galvanizing line.

DESCRIPTION OF THE RELEVANT ART

Prior art steel wire annealing and zinc galvanizing lines are such as described in U.S. Pat. No. 4,390,377. The bare steel wire at ambient temperature is unwound from coils and passed through a cleaning station to remove lubricants. It is then heated in a fossil-fuel-fired oven to raise its temperature to 1350° F. for annealing. After the annealing step it is immersed in acid (hydrochloric or sulfuric) for removal of surface oxides formed during the annealing process, which reduces the temperature back to ambient. It is then immersed in a flux (ammonium chloride or zinc ammonium chloride) to prepare the wire surface for proper adherence by the zinc. From there it is immersed in a tank of molten zinc at 860° F. followed by a wiping process to remove excess zinc and then rewound onto coils.

It is also known to coat steel in an oxygen-free atmosphere, see U.S. Pat. 5,399,376.

The prior art wire annealing and galvanizing utilizes considerable energy. The energy requirements for the fossil fuel-fired oven, which requires heating from ambient and then ultimately cooling over long periods of time, is not energy efficient. Further, the immersion of the wire in acid for the removal of iron oxides results in contaminated waste. Also the immersion of the wire in a flux prior to the zinc coating step also results in wasteful byproducts.

In the present invention, the acid immersion step and the flux immersion steps are eliminated obviating the problem of disposal of toxic waste products into the environment. Further, the energy requirements reduce the costs of energy by about 50%.

BACKGROUND AND BRIEF SUMMARY OF THE INVENTION

Broadly the invention comprises drawing the bare steel wire out of coils which wire is then cleaned to remove lubricants. The cleaned wire is then induction heated by an electric coil in an oxygen-free chamber preferably containing only a mixture of hydrogen/nitrogen in amounts varying between 100–0% to 10–90% preferably 5–95%. This prevents the formation of scale on the steel surface. The wire is annealed at about 1350° F. It is then conveyed to a cooling chamber which also has a mixture of hydrogen and nitrogen and no oxygen and allowed to cool to approximately 860° F. It is then immediately immersed, again without contacting oxygen, into a tank of molten zinc which is also at 860° F. and then subsequently wiped and rewound onto a coil.

This invention eliminates the loss of energy caused by the immersion of heated wire in a cooler acid. The thermal energy put into the wire in the annealing stage is known and used to help maintain the temperature in the molten zinc tank. The hydrogen-nitrogen atmosphere eliminates needs to immerse the strand in acid and fluxes thereby eliminating the need for these two waste materials.

The use of induction heating in the annealing stage permits instant on/off control of the energy source which eliminates long term heat up and cool down cycles and the energy requirement is precisely matched to the energy needs (unlike conventional oven systems). Energy savings using induction heating as compared to typical fossil fuel heating are significant, not only because of better efficiencies achieved with induction heating but also because it is eliminating the waste of energy caused by immersion in acid and/or fluxes and then subsequently having to re-heat the wire to 860° F. Waste is reduced by 100% by the elimination of the acid and flux steps.

Broadly the invention comprises a system and a method in which the wire is annealed in a first oxygen free chamber at a first higher temperature. The wire is cooled to a second lower temperature in a second oxygen free chamber and the wires are galvanized.

BRIEF DESCRIPTION OF THE DRAWING(S)

DESCRIPTION OF THE PREFERRED EMBODIMENT(s)

Broadly, systems for drawing wire through chambers or zones for various process steps is well known. Also maintaining a controlled atmosphere in process steps is well known and need not be described in detail for a full understanding of the invention.

Figure 1:
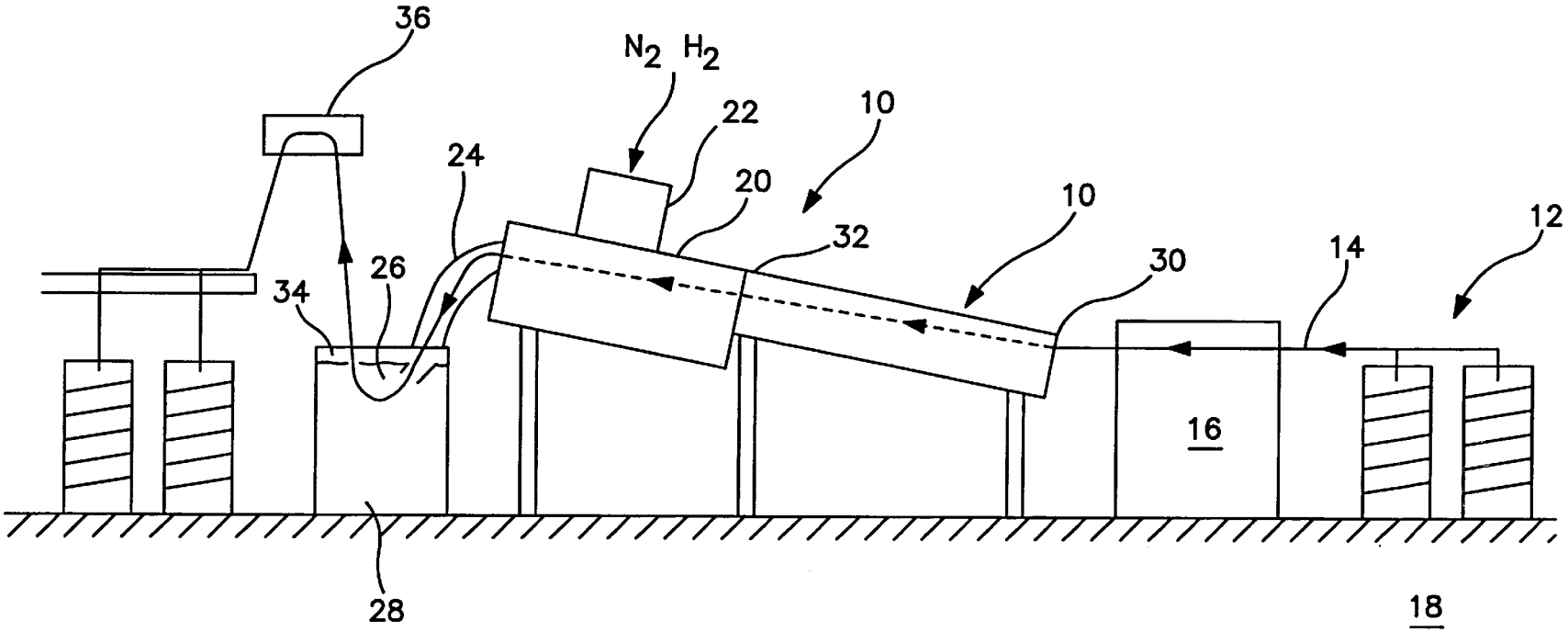
FIG. 1 is a process flow diagram embodying the invention.

Referring to FIG. 1, a system embodying the invention is shown generally at 10 and comprises an induction furnace 10, a cooling chamber 20, a snout 24 and a galvanizing tank 26.

Upstream of the furnace 10 are payoffs 12 which distribute wire 14. Intermediate the furnace 10 and payoffs 12 is a cleaning zone 16.

Figure 2:
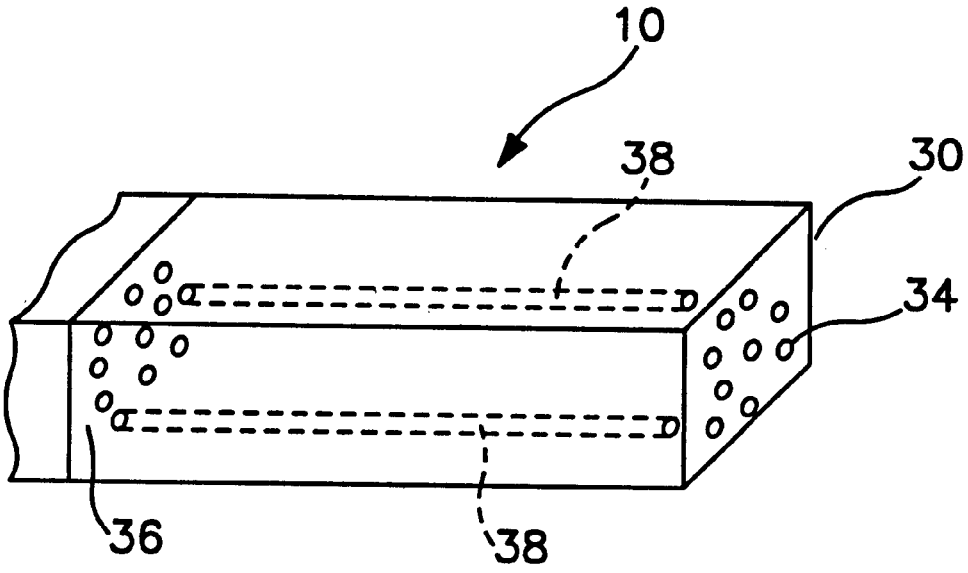
FIG. 2 is a schematic illustration of an induction heater used in the invention.

Referring to FIG. 2, the induction furnace 10 has an upstream end 30 and a downstream end 32. The ends 30 and 32 are apertured plates having apertures 34 and 36. Within the furnace 10 are ganged ceramic tubes 38, each with an associated induction coil (not shown). The tubes 38 are in registration with the apertures 34 and 36.

Interfaced with the induction furnace 10 is the cooling chamber 20. A flow of hydrogen and nitrogen is introduced into the cooling chamber 20 via a duct 22. The hydrogen/nitrogen mixture fills both the cooling chamber 20 and the furnace 10 and is maintained at a positive pressure. In addition to providing a controlled atmosphere, it facilitates the cooling of the annealed wires. The hydrogen/nitrogen mixture is discharged through the apertures 34.

The snout 24 has a depending end 26 which depending end 26 is received in molten zinc in the tank 28. The tank includes a wiping section 34. Subsequently, there is a water quench zone 36 and wire take ups 40.

In a preferred embodiment of the invention there are 18 wires. There can be more or less as desired. A typical non-limiting range 0.035 to 0.148, from Class I to Class III 0.15 to 0.90 oz/$ft_2$ depending on need.

In the operation of the invention, the wires 14 from payoff 12 pass through the cleaning zone 16. A suitable cleaner is sodium hydroxide and sodium bicarbonate compounded with wetting agents. The wires 14 are then drawn through the induction furnace 10. In the induction furnace, a positive pressure atmosphere of the hydrogen/nitrogen mixture in amounts of about 5 and 95% respectively is maintained. The temperature of the tubes 38 is about 1,350° F. Each wire passes through an associated ceramic tube 38.

The wires 14 are then drawn in the cooling chamber 20, which is also a hydrogen/nitrogen atmosphere to prevent the formation of oxides on the wires and the wires are cooled to 850° F.

The wires then travel from the chamber 20 through the snout 24 immersed in molten zinc. This prevents the wires from leaving the hydrogen/nitrogen atmosphere. The temperature of the zinc is about 860° F.

The zinc tank 28 is equipped with a 'sinker' (not shown) to direct the wires 14 down into the zinc and up to the zinc wiping devices 34. The devices 34 well known in the art, can produce coatings as low as up to about 0.8 ounces per square foot. The wires 14 then pass through the water quench zone 36. Subsequently, the wires can be waxed to retard oxidation and to lubricate the wires to assist in further handling. Lastly, the wires are wound on the wire takeups 40.

Structure (not shown) in the cooling section 20, zinc tank 28, the wiping section 34 and water quench zone 36 for maintaining the wires in spaced apart essentially parallel relationship as they move from the wire cleaning section into the annealing section and from the annealing section to the wire takeups are well known in the art and need not be described in detail.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method for annealing and galvanizing wires which comprises:

a) induction heating the wires in a first chamber at a first higher temperature to anneal the wires;

b) cooling the wires to a second lower temperature in a second chamber;

c) galvanizing the wires in a third chamber, each of said chambers being in serial communication; and d) effecting steps a), b) and c) in an oxygen free atmosphere.

2. The method of claim 1 which comprises:

cleaning the wires prior to annealing the wires.

3. The method of claim 1 which comprises:

wiping the wires to control the thickness of the galvanizing coating.

4. The method of claim 1 wherein the first higher temperature is at a temperature of about 1,350° F.

5. The method of claim 1 wherein the second lower temperature is a temperature of about 860° F.

6. The method of claim 5 which comprises:

galvanizing the wires at a temperature of about 860° F.

* * * * *